US008459489B2

(12) United States Patent
Potts et al.

(10) Patent No.: US 8,459,489 B2
(45) Date of Patent: Jun. 11, 2013

(54) ORGANIZER CONTAINER FOR VEHICLE TRUNK OR OTHER USE

(75) Inventors: Kenneth Lee Potts, Solana Beach, CA (US); Debra Lee Potts, Solana Beach, CA (US)

(73) Assignee: Profound Products, Inc., Solana Beach, CA (US)

( * ) Notice: Subject to any disclaimer, the term of this patent is extended or adjusted under 35 U.S.C. 154(b) by 278 days.

(21) Appl. No.: 12/827,450

(22) Filed: Jun. 30, 2010

(65) Prior Publication Data

US 2012/0000912 A1 Jan. 5, 2012

(51) Int. Cl.

| | |
|---|---|
| ***B65D 1/24*** | (2006.01) |
| ***B65D 1/36*** | (2006.01) |
| ***B65D 25/04*** | (2006.01) |
| ***B65D 57/00*** | (2006.01) |
| ***B65D 85/00*** | (2006.01) |

(52) U.S. Cl.

USPC ..... 220/553; 220/520; 220/212; 229/67.3

(58) Field of Classification Search

USPC ..... 220/553, 9.1, 9.2, 9.3, 507, 6, 666, 220/520, 212; 224/539; 383/34, 38, 34.1, 383/119; 206/218, 425, 216; 229/67.1, 67.3; 190/25, 103

See application file for complete search history.

(56) References Cited

U.S. PATENT DOCUMENTS

| | | | | | |
|---|---|---|---|---|---|
| 1,983,418 | A | | 12/1934 | Thurmer | |
| 2,096,768 | A | * | 10/1937 | Styll | 190/100 |
| 2,538,616 | A | * | 1/1951 | Cross | 190/107 |
| 4,260,004 | A | | 4/1981 | Domke | |
| 5,046,860 | A | | 9/1991 | Brennan | |
| 5,207,254 | A | | 5/1993 | Fromm | |
| 5,251,731 | A | * | 10/1993 | Cassese et al. | 190/107 |
| 5,356,004 | A | | 10/1994 | Weinreb | |
| 5,421,172 | A | | 6/1995 | Jones | |
| 5,800,061 | A | * | 9/1998 | Volles | 383/15 |
| 5,842,571 | A | | 12/1998 | Rausch | |
| 5,860,525 | A | | 1/1999 | Bellehchili | |
| 6,186,201 | B1 | | 2/2001 | Salz | |
| D587,897 | S | | 3/2009 | Radke | |
| 2004/0149600 | A1 | | 8/2004 | Wolter | |
| 2005/0098555 | A1 | * | 5/2005 | Wang | 220/6 |
| 2007/0241154 | A1 | * | 10/2007 | Potts et al. | 224/539 |
| 2008/0135142 | A1 | | 6/2008 | Ellis | |
| 2008/0237068 | A1 | | 10/2008 | Melamed | |

OTHER PUBLICATIONS

UnbeatableSale.com, Picnic Time 660-00-179 Cellar 6-Bottle insulated Wine tote with interchangeable liner, http://www.unbeatablesale.com/pt485.html, Dec. 22, 2009.

* cited by examiner

*Primary Examiner* — Luan K Bui
*Assistant Examiner* — Rafael Ortiz
(74) *Attorney, Agent, or Firm* — John L. Rogitz

(57) ABSTRACT

An organizer container includes a fabric body movable into an expanded configuration, wherein the body defines a bottom and above the bottom, a parallelepiped-shaped enclosure divided into three compartments by first and second parallelepiped-shaped divider panels spaced from each other and perpendicularly oriented relative to the bottom. The container also can be moved into a first partially expanded configuration wherein only two compartments are established, with the first divider panel being held substantially flush against a first end wall of the body by a first holding mechanism. The second divider panel likewise may be moved flush against the second end wall and both divider panels can be moved together to entirely collapse the container. A stiffener can be moved within the enclosure to be sandwiched lengthwise between a divider panel and an end wall and/or between two divider panels.

15 Claims, 8 Drawing Sheets

ORGANIZER CONTAINER FOR VEHICLE TRUNK OR OTHER USE

FIELD OF THE INVENTION

The present application relates generally to organizer containers for carrying groceries and for being disposed vehicle trunks or other use.

BACKGROUND OF THE INVENTION

In my U.S. Pat. No. 6,206,224, incorporated herein by reference, an apparatus is provided for reusably carrying groceries and for being transported from the store in a cargo area of a motor vehicle, such as the trunk of a car. As the '224 patent recognizes, previous bags were, among other things, cumbersome. Recognizing this, the '224 patent provided an apparatus which the upstanding sides of which can be folded down or collapsed down to lie flat along a bottom mat which also could be collapsible.

As further understood by present principles, owing to the desired collapsibility of an organizer container and pliability of its fabric, it is desirable to provide a means to stiffen and hold the container in an expanded configuration for carrying items while also maintaining the container in a collapsed configuration so that it does not through material bias partially unfold.

SUMMARY OF THE INVENTION

Accordingly, an organizer container includes a fabric body movable into an expanded configuration. In the expanded configuration, the body defines a bottom and above the bottom, a parallelepiped-shaped enclosure divided into three compartments by first and second parallelepiped-shaped divider panels spaced from each other and perpendicularly oriented relative to the bottom. The container also can be moved into a first partially expanded configuration, in which only two parallelepiped-shaped compartments are established, with the first divider panel being held substantially flush against a first end wall of the body by a first holding mechanism. Furthermore, the container may be moved into a second partially expanded configuration, in which one and only one parallelepiped-shaped compartment is established. In the second partially expanded configuration, the first divider panel is held substantially flush against a first end wall of the body by a first holding mechanism and the second divider panel likewise is held substantially flush against a second end wall of the body by a second holding mechanism. Still further, the container has a collapsed configuration in which the end walls and divider panels are held substantially together by a third holding mechanism. At least a first axially rigid stiffener member is pivotably coupled within the enclosure for movement between an expanded orientation, wherein the stiffener member is sandwiched lengthwise between a divider panel and an end wall of the body, or is sandwiched lengthwise between two divider panels, and a collapse orientation that is substantially orthogonal to the expanded orientation.

The holding mechanisms can be hook and eye mechanisms. The divider panels may be substantially rigid and flat and the stiffener member can be elongated. If desired, the stiffener member is a first stiffener member disposed between the first and second divider panels in the expanded orientation and the container further includes a second stiffener member disposed between the second divider panel and second end wall in the expanded configuration.

The stiffener member may be disposed flush against a divider panel or end wall in the collapse orientation. In some examples, the bottom defines an outer surface and the outer surface in turn defines three successive panel portions that are coplanar with each other when the container is in the expanded configuration. The third holding mechanism may include a pair of hook and eye elements on each panel portion such that when a pair of hook and eye elements is engaged, the respective panel portion is held collapsed.

If desired, a pair of bottom straps can be engaged with the bottom and a pair of top straps can be engaged with respective top edges of the end walls that are distanced from the bottom surface. The first and second holding mechanisms may include at least respective first and second hook and eye elements, with at least one of the elements being disposed at the end of a flexible strap connected to the body.

In another aspect, a device includes a rigid first end wall, a rigid second end wall, at least a rigid first divider panel, and a pliable base connected to at least bottom edges of the end walls and divider panel. The base is structured to constrain the first end wall, the second end wall and the first divider panel to each other so that the first divider panel is located between the first end wall and the second end wall and so that the base is structured to be collapsible between a closed position with the first end wall, the second end wall and the first divider panel being in close face to face proximity to each other and an open position with the second end wall and the first divider panel being spaced apart. The first end wall is moveable between a first angular orientation substantially parallel to the first divider panel and a second angular orientation inclined substantially perpendicular to the first divider panel. At least a first axially rigid stiffener member can be pivotably coupled within the device for movement between an expanded orientation, wherein the stiffener member is sandwiched lengthwise between a divider panel and an end wall of the body, and a collapse orientation that is substantially orthogonal to the expanded orientation.

In another aspect, a method includes moving a container into an expanded configuration, wherein plural compartments are defined within the container between first and second end walls. At least one divider panel is disposed between the end walls and is parallel to each end wall. A pliable bottom extends from one end wall to the other end wall. The method also includes pivoting a stiffener member from being flush against an end wall or divider panel to being perpendicular to an end wall and disposed between an end wall and the divider panel to hold at least a portion of the bottom between the end wall and divider panel substantially taut. The stiffener member can be pivoted to be flush against an end wall or divider panel, and with the stiffener member flush against an end wall or divider panel, the divider panel can be moved against an end wall.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
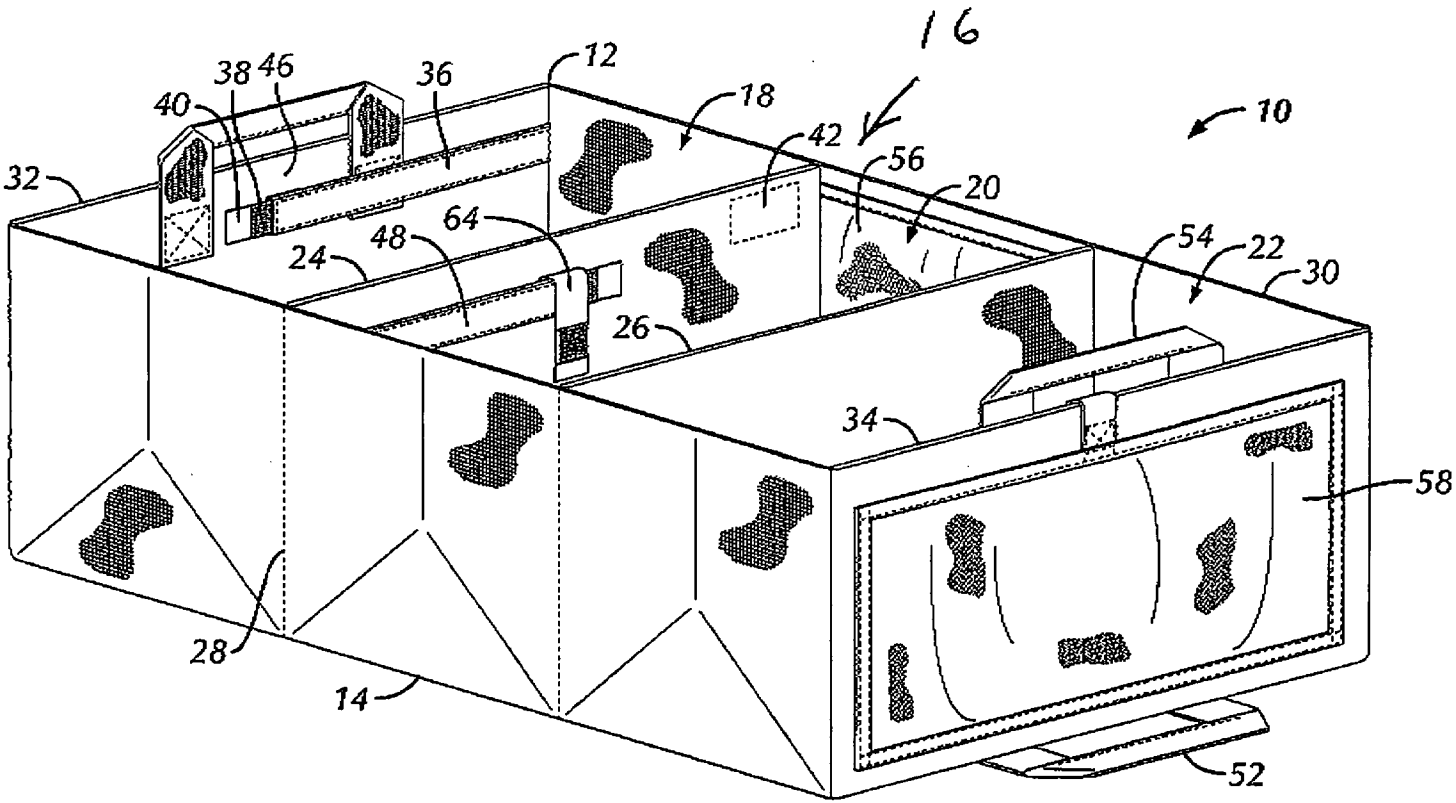
FIG. 1 is a perspective view of the Organizer Container in the expanded configuration with the stiffener members in the retracted configuration, showing all three parallelepiped shaped enclosures established, taken from a perspective referred to herein for ease of disclosure as the front right.
Figure 2:
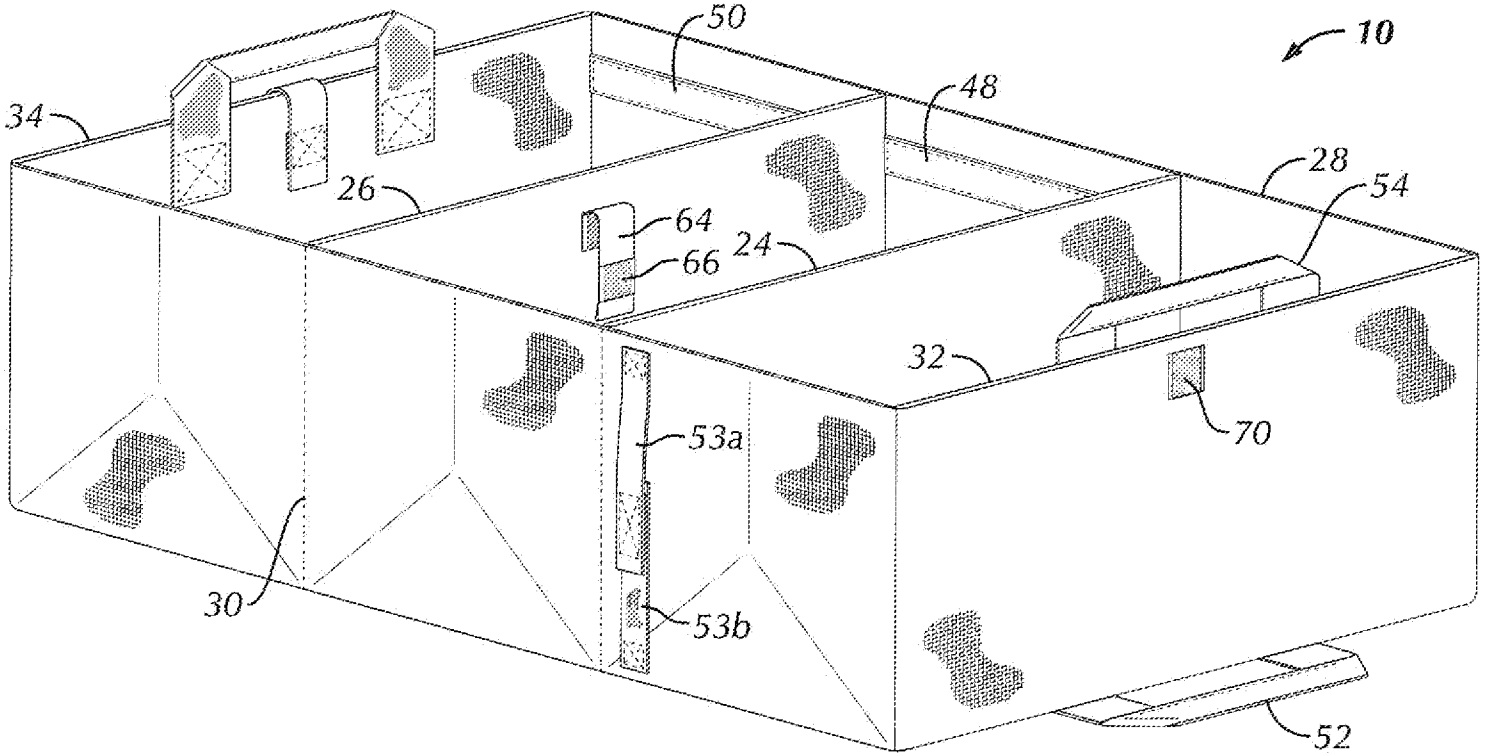
FIG. 2 is a perspective view of the Organizer Container in the expanded configuration with the stiffener members in the extended configuration, showing all three parallelepiped shaped compartments established, taken from the opposite angle of the container as shown in FIG. 1 (i.e., taken from the left rear)

Referring initially to FIGS. 1 and 2, an organizer container 10 includes a fabric body 12 made of pliable material such as but not limited to nylon or canvas that can be moved into the various configurations described below. In the embodiment shown in FIGS. 1 and 2, the body 12 is shown in an expanded configuration.

In the expanded configuration, the body 12 defines a pliable rectangular bottom 14 and above the bottom 14, a parallelepiped-shaped enclosure 16 which is divided into left, middle, and right parallelepiped-shaped compartments 18, 20, 22 by left and right flat rectilinear divider panels 24, 26. The divider panels 24, 26 are spaced from each other as shown and are perpendicularly oriented relative to the bottom 14 in the expanded configuration of FIGS. 1 and 2. It is to be understood that while FIGS. 1 and 2 show two divider panels and three compartments, present principles generally apply to two or more compartments with concomitant one or more divider panels.

Each compartment 18, 20, 22 is bounded by respective pliable front and back walls 28, 30, which may be separately formed and connected together along their vertical edges or which may be integrally formed with each other. The middle compartment 20 is bounded at its ends by the divider panels 24, 26 as shown, whereas the left compartment 18 is bounded by a left end wall 32 and divider panel 24 and the right compartment 22 is bounded by a right end wall 34 and right divider panel 26. In one implementation, unlike the front and back walls 28, 30 and bottom 14, the end walls 32, 34 and divider panels 24, 26 are not pliable but rather are reinforced with interior substantially rigid planar panels made of pressboard, cardboard, or the like.

It is to be understood that relative terms such as "back", "front", "left", and "right" are used herein for ease of exposition only. For instance, if the container is inverted the bottom 14 will be positioned above the remainder of the body 12 without departing from the intention or scope of present principles.

Figure 2A:
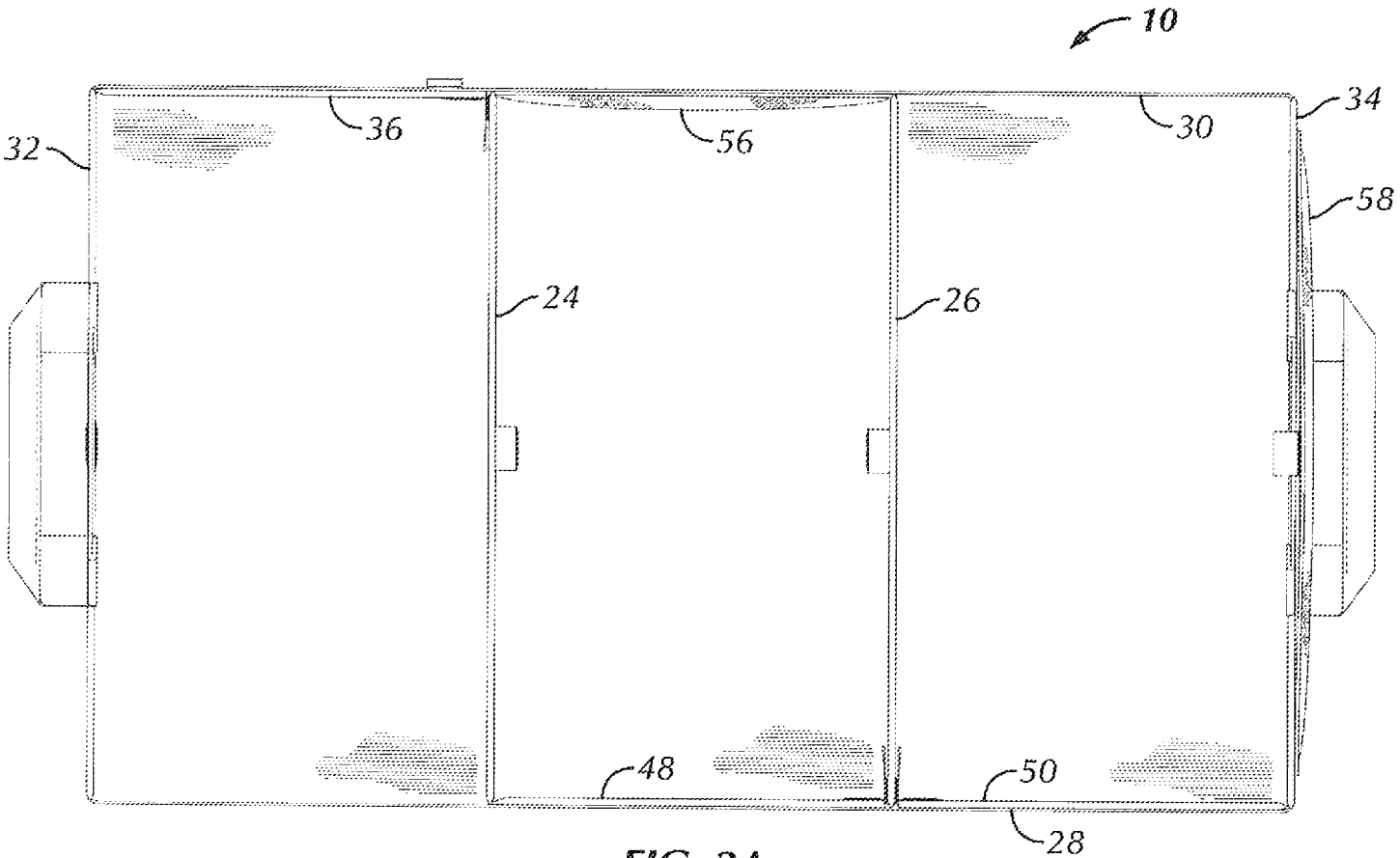
FIG. 2A is a top plan view of the container shown in FIG. 2.

FIGS. 1, 2, and 2A show that in one example, at least a first axially rigid stiffener member 36, preferably narrow in the top-to-bottom dimension and elongated in the left-to-right dimension, is pivotably coupled within the enclosure for movement in a plane that is above and parallel to the bottom 14 between an expanded orientation (FIG. 2A), in which the stiffener member 36 is sandwiched lengthwise between the left end wall 32 and left divider panel 24 to hold them distanced from each other and parallel to each other as shown, and a collapse orientation (FIG. 1) that is substantially orthogonal to the expanded orientation. In the collapse orientation of FIG. 1, the stiffener member 36 is disposed flush against the end wall 32 as shown. It will be appreciated that the length of the stiffener member 36 closely approximates the width of the back wall 30 of the left compartment 18 when the back wall 30 is taut in the expanded configuration.

In the example shown, the first stiffener member 36 may be implemented by fabric-covered pressboard and can be sewn or otherwise pivotably engaged at the corner between the left end wall 32 and back wall 30 near the open top edges thereof such that the first stiffener member 36 can pivot between the orientations shown in FIGS. 1 and 2A. If desired, a first fastener element 38 such as a hook-and-eye fastener patch can be provided on a strap 40 protruding from the free end of the stiffener member 36 to engage a complementary fastener element 42 (shown in phantom) such as a complementary hook-and-eye fastener patch on the back edge of the left divider panel 24 to releaseably hold the stiffener member 36 in the expanded orientation of FIG. 2A. Likewise, a second fastener element can be provided on the left surface of the stiffener member 36 to releaseably engage a complementary fastener element 46 on the inner surface of the left end wall 32 to hold the stiffener member 36 in the collapse orientation of FIG. 1. It will be further appreciated that a person can easily engage and disengage the stiffener member fastener elements with the corresponding complementary fastener elements to hold the stiffener member 26 in the desired orientation.

In the specific example shown, in addition to the first stiffener member 36, second and third stiffener members 48, 50 can also be provided that are substantially identically configured to the first stiffener member 36. The second stiffener member 48 (FIGS. 1, 2, and 2A) may be pivotably engaged with the body 12 at the corner between the left divider panel 24 and front wall 28 to releaseably hold the middle compartment 20 in the expanded orientation in accordance with principles above by extending between the divider panels 24, 26 in the middle compartment 20. Likewise, the third stiffener member 50 (FIGS. 2 and 2A) may be pivotably engaged with the body 12 at the corner between the right divider panel 26 and front wall 28 to releaseably hold the right compartment 22 in the expanded orientation in accordance with principles above by extending between the right divider panel 26 and right end wall 34 in the right compartment 22. Fastener elements may be provided on the second and third stiffener members 48, 50 to hold them in the expanded and collapse orientations in accordance with above principles.

In the non-limiting example shown, carrying straps may be provided that a person can grasp to carry the container 10. In one example, a pair of bottom straps 52 are respectively provided to depend down from the left and right walls 32, 34 past the bottom 14. Also, a pair of top straps 54 can be engaged with respective top edges of the end walls 32, 34 that are distanced from the bottom 14. In the embodiment shown the straps 52, 54 are midway between the front and back walls 28, 30.

Further, top and bottom seat belt straps 53*a*, 53*b* (FIG. 2) may be respectively sewn at their top and bottom ends to the top and bottom edges of the container 10 as shown. The seat belt straps overlap with each other as shown and along their regions of overlap have hook-and-eye fasteners so that the straps 53*a*, 53*b* can be connected to each other and disconnected to each other as desired. With this structure, the container 10 can be positioned on the front seat of a vehicle to act as a front seat caddy, the straps 53*a*, 53*b* disconnected and positioned around a closed seat belt of the vehicle, and then reconnected together to secure the container 10 to the seat in its function as a front seat caddy. When functioning as a front seat caddy, the container 10 may be moved to one of the single-compartment configurations shown in the drawings and/or described herein.

If desired, an interior web pouch 56 (FIG. 1) can be provided in the middle compartment 20 on the back wall 30 thereof, for containing smaller items. Also, an exterior web pouch 58 can be provided on the exterior surface of the right end wall 34 for containing smaller items.

Figure 3:
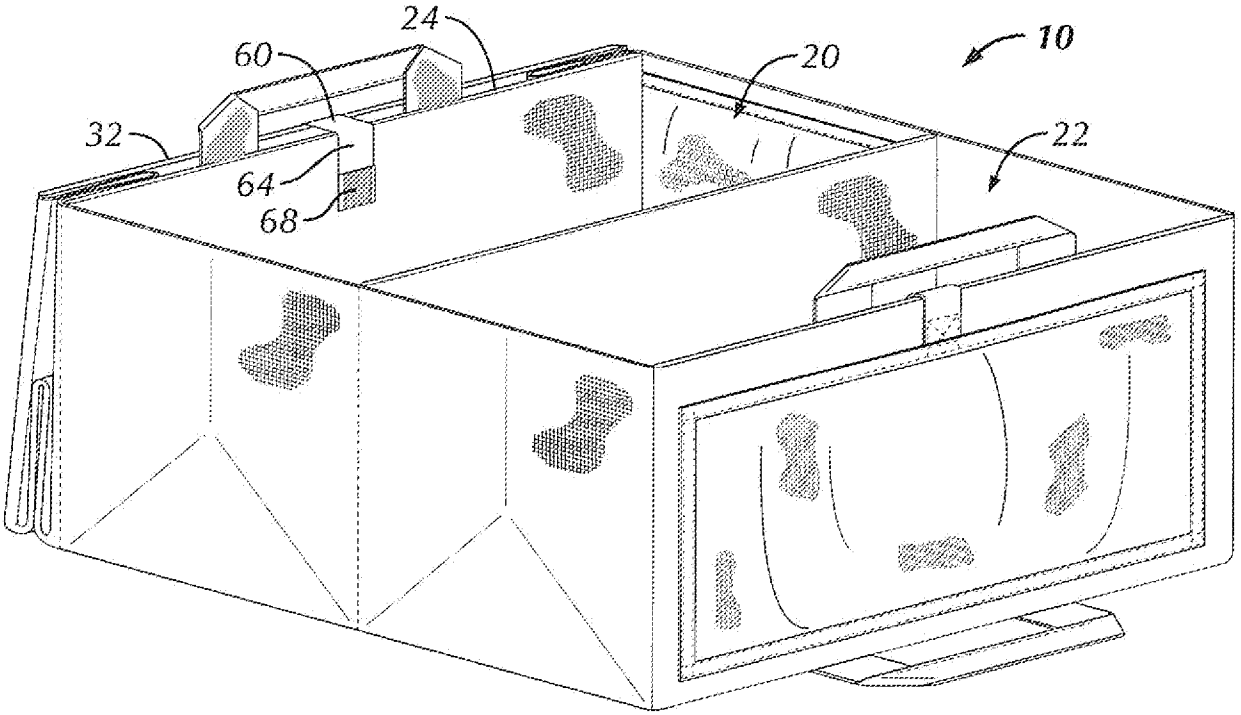
FIG. 3 is a perspective view of the Organizer Container in a partially expanded configuration, showing the cooperation of one of the upper hook and eye straps to hold one of the divider panels flush against a side wall so that only two parallelepiped shaped compartments are established, taken from the same perspective as FIG. 1.
Figure 4:
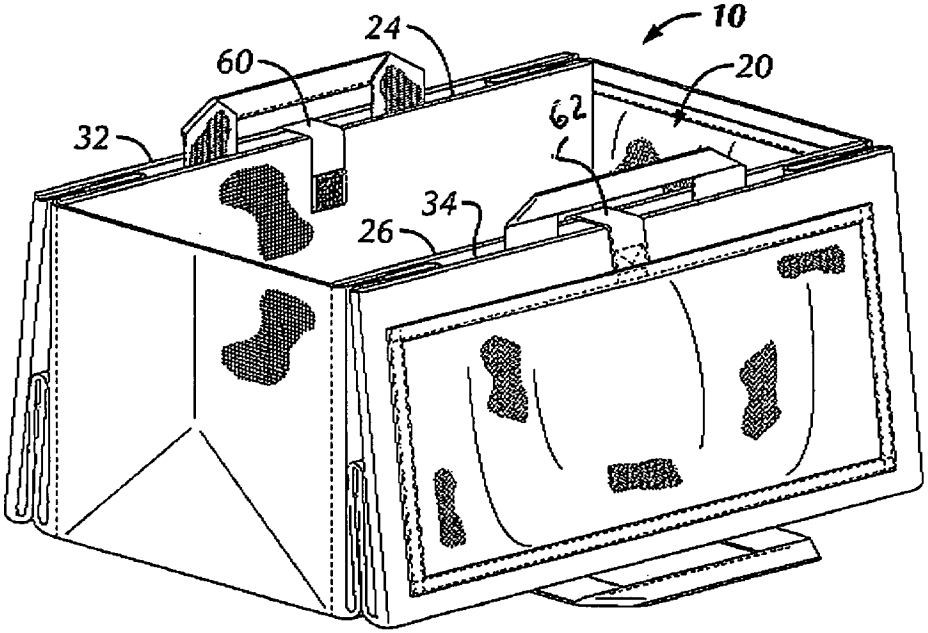
FIG. 4 is a perspective view of the Organizer Container in a partially expanded configuration, showing the cooperation of both of the upper hook and eye straps to hold both of the divider panels flush against respective side walls so that only a single parallelepiped shaped compartment is established, taken from the same perspective as FIG. 1.

Attention is now directed to FIGS. 1, 3, and 4 to gain understanding into first partially expanded configurations into which the body 12 may be configured. In the first partially expanded configuration of FIG. 3, only two parallelepiped-shaped compartments (in the example shown, the middle and right compartments 20, 22) are established, because the left divider panel 24 is held substantially flush against the left end wall 32 (i.e., with perhaps a small air gap therebetween) preferably by an upper left holding mechanism 60, which may be a hook-and-eye holding mechanism. In contrast, in the second partially expanded configuration of FIG. 4, one and only one parallelepiped-shaped compartment (the middle compartment 20) is established, because the left divider panel 24 is held substantially flush against the left end wall 32 by the upper left holding mechanism 60 and the right divider panel 26 is held substantially flush against the right end wall 34 by an upper right holding mechanism 62 that may be identical in configuration and operation to the upper left holding mechanism 60.

Cross-reference is now had to FIGS. 2 and 3, in which various portions of two separate holding mechanisms will be referred to for a complete understanding of how a holding mechanism functions, it being understood that the two mechanisms 60, 62 are identical in configuration and operation. Accordingly, for brevity focus will be on the left holding mechanism 60, which includes a flexible webbing or fabric strap 64 sewn or otherwise attached to a divider panel, with one strap 64 being attached to the right surface of the left divider panel 24 and the other strap 64 attached to the left surface of the right divider panel 26. A left side hook-and-eye element 66 (FIG. 2) such as a hook pad is attached to the left side of the strap 64 and a right side element 68 (FIG. 3) such as another hook pad is attached to the right side of the strap 64 opposite the left side pad. With the left stiffener member 36 in the collapse orientation, the left divider panel 24 can be moved flush against the left end wall 32, collapsing the portion of the bottom 14 and front and back walls 28, 30 that extend between the left divider panel 24 and left end wall 32. The strap 64 can then be folded over the top of the left end wall 32 such that its left side hook-and-eye element 66 can be engaged with an eye pad attached to the outer surface of the left end wall 32. While FIG. 3 does not show the eye pad, FIG. 2 shows an eye pad 70 located on an end wall for engaging the opposite strap.

Similarly, the right stiffener member 48 can be moved to the collapse orientation, the right divider panel 26 moved against the right end wall 34, and the upper right holding mechanism 62 used to hold the two together (FIG. 4).

It may now be appreciated that one or both of the left and right compartments 18, 22 may be collapsed with the end walls 32, 34 remaining oriented perpendicular to the bottom 14, so that the example container shown can be easily configured by a person to have one (FIG. 4), or two (FIG. 3), or three (FIGS. 1 and 2) compartments as the need dictates.

Figure 5:
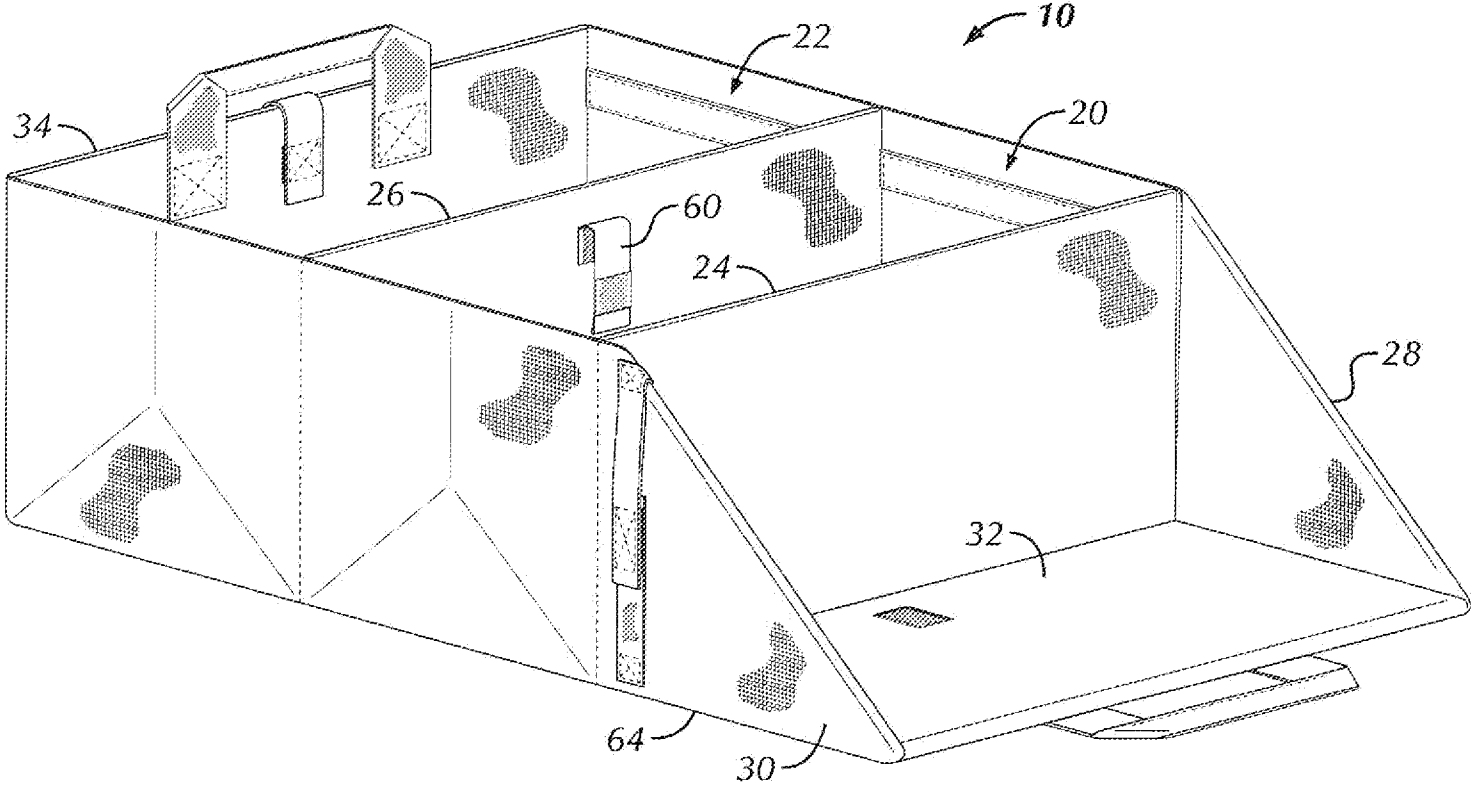
FIG. 5 is a perspective view of the Organizer Container in a partially expanded configuration, showing one of the end walls pivoted flat (orthogonal) with respect to the divider panels and other end wall, it being understood that the other end wall may similarly be pivoted flat in lieu thereof or in addition thereto, taken from the same perspective as FIG. 2.

In addition and now turning to FIG. 5, another type of partially expanded configuration is shown in which one of the end walls 32 is pivoted flat against the bottom 14 and thus is orthogonal to the divider panels 24, 26, with the front and back walls 28, 30 folding in accommodation. Likewise, the other end wall may also be folded flat against the bottom 14, or the opposite compartment 22 may be collapsed to its configuration shown in FIG. 4. Greater container stability during transit is achieved thereby, albeit at the diminution of compartment space within the container.

Figure 7:
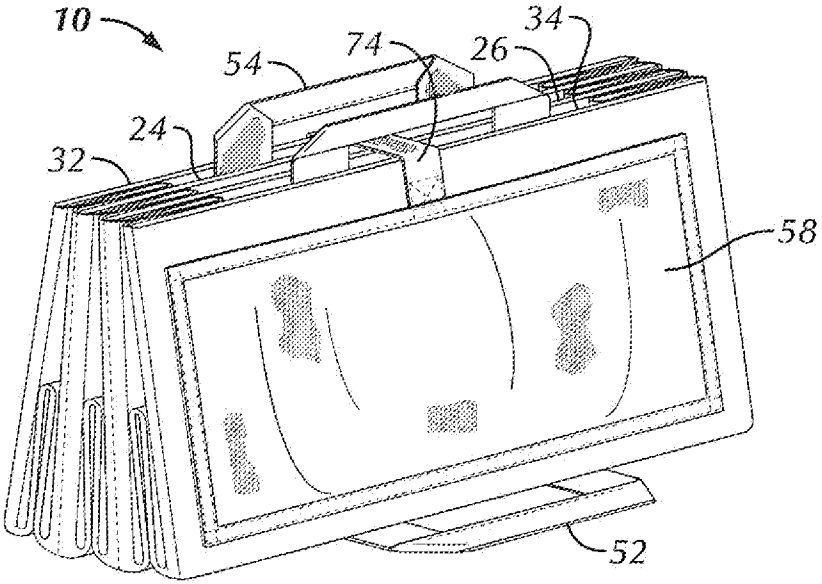
FIG. 7 is a perspective view of the Organizer Container in the collapsed configuration, showing the cooperation of the external hook and eye elements on the bottom panel in holding the container in the collapsed configuration, taken from the same perspective as FIG. 1.

FIG. 7 illustrates the collapsed configuration of the container, wherein the end walls 32, 34 and divider panels 24, 26 are held substantially together by a collapse strap 74. It is to be understood that the collapse strap 74 is attached to the right (or left) end wall 34. When the body 12 is in the collapsed configuration shown in FIG. 7, the collapse strap 74 can be folded across the tops of the divider panels and opposite end wall and pulled down until a hook and element on the free end of the collapse strap 74 releaseably engages a complementary element on the outer surface of the opposite end wall to hold the body 12 in the collapsed configuration.

To prevent the bottom 14 from accordion-like expansion while the top portions of the walls and dividers are held together, a bottom holding member can be provided on the outer (bottom) surface of the bottom 14.

Figure 6:
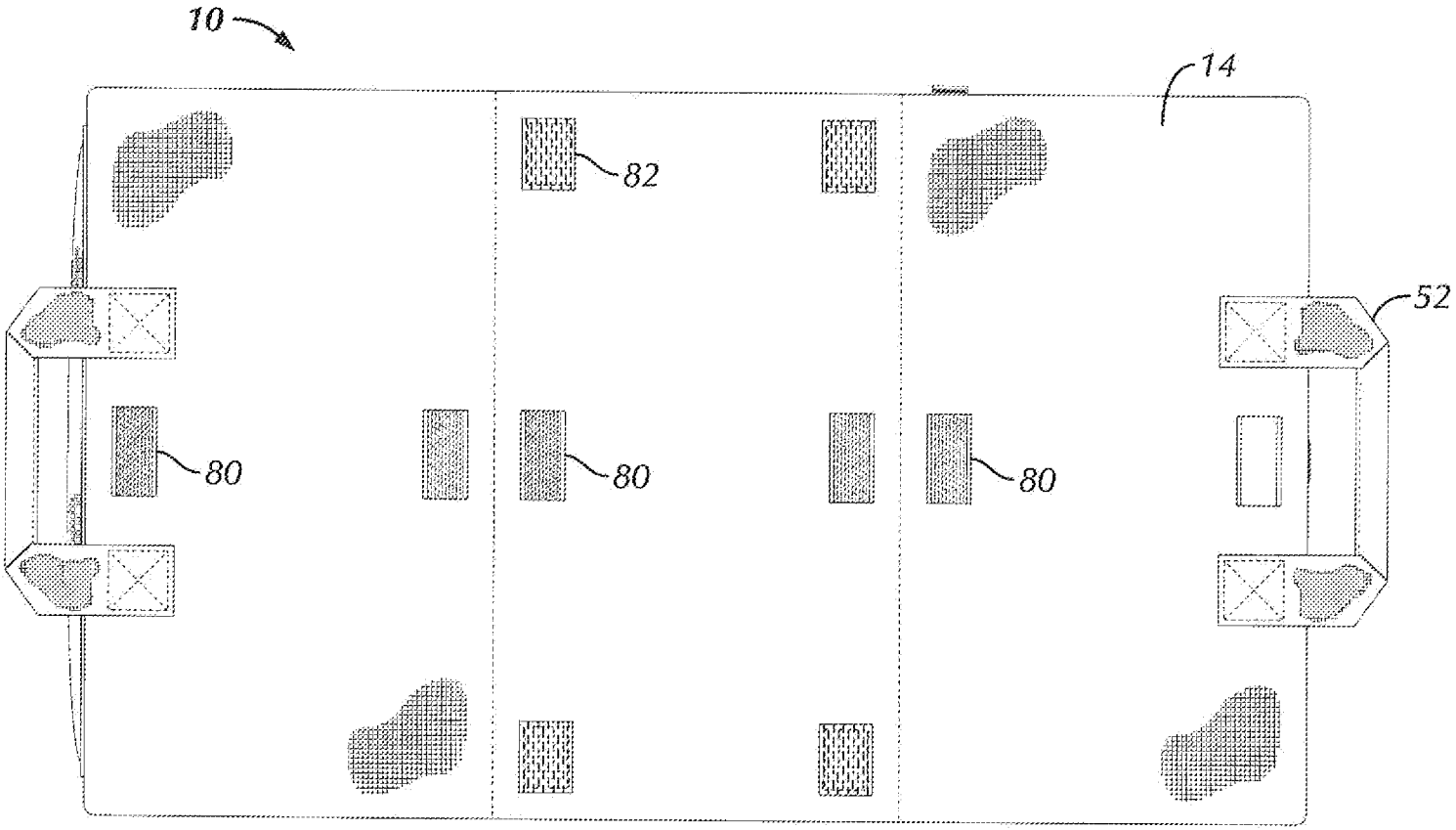
FIG. 6 is a plan view of the bottom panel in the expanded configuration, showing the hook-and-eye holding member.

With greater specificity and as best shown in FIG. 6, the outer surface of the bottom 14 can be thought of as defining three successive panel portions that are coplanar with each other when the container is in the expanded configuration (FIG. 6), and the third holding member includes a pair of hook and eye elements 80 on each panel portion as shown. When the container is moved to the collapsed configuration of FIG. 7, the elements of a pair 80 face each other and are engaged to hold the respective panel portion collapsed, i.e., in the configuration shown in FIG. 7. In the example shown, the elements of each pair 80 are arranged in a line as shown. If desired, the central bottom panel can have four corner support pads 82 as shown on which the container can rest.

In some embodiments the divider panels 24, 26 can be held to the front and back walls 28, 30 by hook and eye mechanisms, in lieu of being more permanently sewn thereto. With this structure, one or both divider panels 24, 26 may be folded flush against the bottom of the container from their vertical positions shown in FIG. 1 to establish one large interior space.

It may now be appreciated that the pliable body 12 is connected at least to the bottom edges of the end walls and divider panels and is structured to constrain the end walls and divider panels to each other so that the divider panels are located between the end walls. It may also be appreciated that the body 12 is structured to be moved from a collapsed configuration (FIG. 7) in which the end walls and divider panels are in close face to face proximity to each other and an expanded configuration (FIGS. 1 and 2) with one of the end walls and a divider panel being spaced apart and further with one or both end walls moveable between a first angular orientation substantially parallel to the divider panels and a second angular orientation inclined substantially perpendicular to the divider panels (FIG. 5).

While the particular ORGANIZER CONTAINER FOR VEHICLE TRUNK OR OTHER USE is herein shown and described in detail, it is to be understood that the subject matter which is encompassed by the present invention is limited only by the claims.

What is claimed is:

1. Organizer container comprising:

fabric body movable into:

an expanded configuration, wherein the body defines a bottom and above the bottom a parallelepiped-shaped enclosure divided into first, second, and third compartments by first and second parallelepiped-shaped divider panels spaced from each other and perpendicularly oriented relative to the bottom, a first partially expanded configuration, wherein only two parallelepiped-shaped compartments are established, the first divider panel being held substantially flush against a first end wall of the body by a first holding mechanism;

a second partially expanded configuration, wherein one and only one parallelepiped-shaped compartment is established, the first divider panel being held substantially flush against the first end wall by the first holding mechanism and the second divider panel being held substantially flush against a second end wall of the body by a second holding mechanism;

a collapsed configuration, wherein the end walls and divider panels are held substantially together by a third holding mechanism; and at least first, second, and third axially rigid stiffener members disposed in the respective first, second, and third compartments and pivotably coupled within the enclosure for movement in a horizontal plane between an expanded orientation, wherein the first or third stiffener member is sandwiched lengthwise between a divider panel and an end wall of the body in contact with both the divider panel and the end wall of the body, and the second stiffener member is sandwiched lengthwise between two divider panels in contact with both divider panels, and a collapse orientation in which a stiffener member is substantially orthogonal to the expanded orientation, the stiffener members being narrower in a top-to-bottom dimension defined by the container than the divider panels and end walls of the container.

2. The container of claim 1, wherein the holding mechanisms are hook and eye mechanisms.

3. The container of claim 1, wherein the divider panels are substantially rigid and flat.

4. The container of claim 1, wherein the stiffener member is elongated.

5. The container of claim 1, wherein the stiffener member is a first stiffener member disposed between the first and second divider panels in the expanded orientation and the container further comprises a second stiffener member disposed between the second divider panel and second end wall in the expanded configuration.

6. The container of claim 1, wherein the stiffener member is disposed flush against a divider panel or end wall in the collapse orientation.

7. The container of claim 1, wherein the bottom defines an outer surface and the outer surface in turn defines three successive panel portions that are coplanar with each other when the container is in the expanded configuration, and the third holding mechanism includes a pair of hook and eye elements on each panel portion such that when a pair of hook and eye elements is engaged, the respective panel portion is held collapsed.

8. The container of claim 1, comprising a pair of bottom straps engaged with the bottom and a pair of top straps engaged with respective top edges of the end walls that are distanced from the bottom surface.

9. The container of claim 1, wherein the first and second holding mechanisms include at least respective first and second hook and eye elements, at least one of the elements being disposed at the end of a flexible strap connected to the body.

10. A device comprising:

a rigid first end wall;

a rigid second end wall;

at least a rigid first divider panel;

a pliable base connected to at least bottom edges of the end walls and divider panel and structured to constrain the first end wall, the second end wall and the first divider panel to each other so that the first divider panel is located between the first end wall and the second end wall and so that the base is structured to be collapsible between a closed position with the first end wall, the second end wall and the first divider panel being in close face to face proximity to each other and an open position with the second end wall and the first divider panel being spaced apart and the first end wall is moveable between a first angular orientation substantially parallel to the first divider panel and a second angular orientation inclined substantially perpendicular to the first divider panel, the base defining a front and a back;

at least a first axially rigid stiffener member pivotably coupled within the device for movement between an expanded orientation, wherein the stiffener member is sandwiched lengthwise between a first divider panel oriented vertically and an end wall of the body in contact with both the first divider panel and end panel, and a collapse orientation that is substantially orthogonal to the expanded orientation; and a second divider panel, the first divider panel being disposed between the second divider panel and the end wall, a second stiffener member being disposed between the first and second divider panels in an expanded configuration, the second stiffener member also being pivotable to a collapse orientation orthogonal to the expanded orientation, wherein:

the first stiffener member is pivotably connected at a first hinge location near the first end wall and the back defined by the base, and the second stiffener member is pivotably connected at a second hinge location near the first divider panel and the front defined by the base.

11. The device of claim 10, wherein the device is movable to a collapsed configuration, wherein the end walls and divider panel are held substantially together by a holding member.

12. The device of claim 11, wherein the base defines an outer surface and the outer surface in turn defines three successive panel portions that are coplanar with each other in an expanded configuration, and the holding member includes a pair of hook and eye elements on each panel portion such that when a pair of hook and eye elements is engaged, the respective panel portion is held collapsed.

13. The device of claim 10, wherein the stiffener member is disposed flush against a divider panel or end wall in the collapse orientation.

14. The device of claim 10, comprising a pair of bottom straps engaged with the base and a pair of top straps engaged with respective top edges of the end walls that are distanced from the bottom surface.

15. The device of claim 10, wherein:

the first end wall is pivotable between a first angular orientation in the expanded configuration and a second angular orientation orthogonal to the first angular orientation.

* * * * *